US009895743B2

(12) United States Patent
Rathner

(10) Patent No.: US 9,895,743 B2
(45) Date of Patent: Feb. 20, 2018

(54) METHOD AND DEVICE FOR CASTING A CAST PART

(71) Applicant: Fill Gesellschaft m.b.H., Gurten (AT)

(72) Inventor: Wolfgang Rathner, Ried/Innkreis (AT)

(73) Assignee: Fill Gesellschaft m.b.H., Gurten (AT)

( * ) Notice: Subject to any disclaimer, the term of this patent is extended or adjusted under 35 U.S.C. 154(b) by 162 days.

(21) Appl. No.: 14/893,750

(22) PCT Filed: May 27, 2014

(86) PCT No.: PCT/AT2014/050124

§ 371 (c)(1),
(2) Date: Nov. 24, 2015

(87) PCT Pub. No.: WO2014/190366

PCT Pub. Date: Dec. 4, 2014

(65) Prior Publication Data

US 2016/0101467 A1 Apr. 14, 2016

(30) Foreign Application Priority Data

May 27, 2013 (AT) ..... A 50356/2013
Aug. 16, 2013 (AT) ..... A 50509/2013

(51) Int. Cl.
*B22D 23/00* (2006.01)
*B22D 41/04* (2006.01)
*B22D 46/00* (2006.01)

(52) U.S. Cl.
CPC ..... *B22D 23/006* (2013.01); *B22D 41/04* (2013.01); *B22D 46/00* (2013.01)

(58) Field of Classification Search
CPC ..... B22D 23/006; B22D 46/00; B22D 41/04
See application file for complete search history.

(56) References Cited

U.S. PATENT DOCUMENTS 1,189,548 A 7/1916 Durville
3,435,883 A 4/1969 Fromson
(Continued)

FOREIGN PATENT DOCUMENTS

CH 477 931 A 9/1969
DE 686 764 C 1/1940
(Continued)

OTHER PUBLICATIONS

English machine translation of DE102006058142.*
International Search Report of PCT/AT2014/050124, dated Oct. 30, 2014.

*Primary Examiner* — Kevin P Kerns
*Assistant Examiner* — Steven Ha
(74) *Attorney, Agent, or Firm* — Collard & Roe, P.C.

(57) ABSTRACT

The invention relates to a method for casting a cast part according to the tilt pour casting principle, and the metal melt (1) is poured from at least one tiltable casting vessel (2) into a casting mold (3) having a mold cavity (4) that forms the cast part, and the at least one casting vessel (2) and the casting mold (3) are arranged next to each other in one step, and in a subsequent step the metal melt (1) is settled, and the at least one casting vessel (2) and the casting mold are positioned in such a way before pouring the metal melt (1) from the at least one casting vessel (2) into the casting mold (3) that a settled level (a) of the metal melt (1) in the at least one casting vessel (2) is at the same height as a section of an inner surface of the casting mold (3).

19 Claims, 5 Drawing Sheets

(56) References Cited

U.S. PATENT DOCUMENTS

| | | | | |
|---|---|---|---|---|
| 5,381,855 | A | 1/1995 | Mezger | |
| 5,704,413 | A | 1/1998 | Takasaki et al. | |
| 6,715,535 | B2 | 4/2004 | Kahn et al. | |
| 8,245,759 | B2 | 8/2012 | Goettsch | |
| 8,302,659 | B2 | 11/2012 | Smetan et al. | |
| 8,770,264 | B2 | 7/2014 | Lange et al. | |
| 2005/0023737 | A1* | 2/2005 | Takahashi | B22D 1/002 266/217 |
| 2009/0229782 | A1* | 9/2009 | Takada | B22D 23/006 164/336 |
| 2010/0324719 | A1 | 12/2010 | Ota et al. | |

FOREIGN PATENT DOCUMENTS

| | | | |
|---|---|---|---|
| DE | 10 2004 015 649 | B3 | 8/2005 |
| DE | 10 2006 058 142 | A1 | 6/2008 |
| DE | 10 2009 023 881 | A1 | 1/2010 |
| DE | 20 2009 012 656 | U1 | 2/2010 |
| DE | 10 2010 023 646 | A1 | 1/2011 |
| DE | 10 2010 022 343 | A1 | 12/2011 |
| DE | 10 2011 052 366 | A1 | 2/2013 |
| EP | 0 592 365 | A1 | 4/1994 |
| EP | 1 155 763 | A1 | 11/2001 |
| JP | 02175065 | A * | 7/1990 |
| JP | H08-168871 | A | 7/1996 |
| WO | 2010/058003 | A1 | 5/2010 |
| WO | 2010/068113 | A1 | 6/2010 |
| WO | 2011/151007 | A1 | 12/2011 |
| WO | 2013/017371 | A1 | 2/2013 |

* cited by examiner

METHOD AND DEVICE FOR CASTING A CAST PART

CROSS REFERENCE TO RELATED APPLICATIONS

This application is the National Stage of PCT/AT2014/050124 filed on May 27, 2014, which claims priority under 35 U.S.C. § 119 of Austrian Application Nos. A 50356/2013 filed on May 27, 2013, and A 50509/2013 filed on Aug. 16, 2013, the disclosures of which is incorporated by reference. The international application under PCT article 21(2) was not published in English.

The invention relates to a method for casting a cast part based on the tilt pour casting principle, whereby metal melt is poured from at least one tiltable casting vessel into a casting mold having a mold cavity that forms the cast part.

The invention further relates to a device for tilt pour casting comprising at least one casting vessel and at least one casting mold, which casting vessel and casting mold can be connected to one another.

A tilt pour casting method is known from WO2010/058003A1. Based on this known method, the metal melt is poured into a casting mold by means of a casting vessel, also referred to as a casting ladle. With this known method, the pouring process is set in motion by tilting the casting vessel. At this stage, the casting vessel and the level of the melt in the casting vessel are disposed at a higher level than the casting mold so that the melt enters the casting vessel with relatively high kinetic energy.

Other methods and devices for tilt pour casting are also described in U.S. Pat. No. 5,704,413A and DE 102010022343 A1. A method and a device of the type outlined above are known from DE 102009023881 A1.

The disadvantage of the known methods is that turbulence occurs in the melt right from the start of pouring the metal melt from the casting vessel into the casting mold, which can impair the microstructure of the cast part.

It is therefore an objective of the invention to propose a new tilt pour casting method which does not have the aforementioned problems.

As proposed by the invention, this objective is achieved by a method of the type outlined above whereby the at least one casting vessel and the casting mold are placed next to one another in one step, and in a subsequent step the metal melt is settled, and the at least one casting vessel and the casting mold are positioned in such a way that, before pouring the metal melt from the at least one casting vessel into the casting mold, a settled level of the metal melt in the at least one casting vessel is at the same height as a section of an inner surface of the casting mold.

The invention enables the melt to be poured into the casting mold very calmly and free of turbulence. Since the settled level of the metal melt is already disposed at the level of the casting mold at the start of the pouring operation, the metal melt is transferred to the casting mold at a lower speed so that the casting mold is filled with a settled melt front. This enables turbulence and irregularities in the casting to be very effectively prevented.

Based on a preferred embodiment enabling particularly smooth pouring of the metal melt into the mold cavity, the at least one casting vessel and the casting mold are positioned in such a way before pouring that the settled level of the metal melt in the at least one casting vessel is at least at the same height as the deepest section of the mold cavity.

Rapid settling of the metal melt before pouring and a settled melt front at the start of the pouring operation can be achieved more easily if the at least one casting vessel and the casting mold are positioned in such a way before pouring that the settled level of the metal melt at the start of the pouring operation extends parallel with a wall section, in particular a base, of the at least one casting vessel.

It has proved to be of particular advantage if the casting vessel has a gate opening directly into the mold cavity and the mold cavity is directly connected to the casting vessel via the gate during the process of pouring the metal melt.

Based on another advantageous embodiment of the invention, the gate may extend across essentially an entire width of the mold cavity facing the casting vessel and some of the melt remains in the gate as a feeder volume.

A simple start to the casting process can be obtained if the process of pouring the metal melt is initiated by tilting the casting vessel in the direction of the casting mold or the casting vessel and the casting mold are jointly rotated in the same direction about a common axis in order to initiate the pouring operation.

Based on a preferred variant of the invention, the casting vessel is spatially separated from the casting mold during the process of filling it with metal melt and after filling is moved to the casting mold and affixed to the casting mold by a robot arm.

Another advantageous variant of the invention is one whereby the casting vessel filled with the metal melt is moved to the casting mold with a pendulum motion and the pendulum movements are effected in the direction opposite oscillations of the metal melt. This variant of the invention enables a very rapid processing time to be achieved because it is not necessary to wait until the metal melt has settled before pouring, having moved the casting vessel to the casting mold.

Based on a preferred embodiment of the invention, the level of the metal melt is detected by means of sensors.

The objective outlined above can also be achieved by means of a device proposed by the invention, whereby the casting vessel and casting mold can be connected to one another and characterized by the fact that having connected the casting vessel and casting mold, an end face of the casting vessel facing the casting mold extends parallel with an end face of a feeder of the casting mold and/or the end faces are disposed congruently with one another and the end faces lie one against the other.

The device proposed by the invention enables very smooth pouring of the melt from the casting vessel into the casting mold. One advantage of the solution proposed by the invention is that it very effectively prevents the melt from plunging as it is poured into the casting mold and guarantees approximately laminar flow conditions.

In one advantageous variant of the invention which also guarantees an optimum sealing surface between the casting vessel and casting mold, the end faces of the casting vessel and feeder complement one another in terms of their surfaces and their contours.

Based on one variant of the invention which is distinctive due to good pouring behavior, an external face of the at least one casting vessel facing an external face of the at least one casting mold and the external face of the at least one casting mold subtend an acute angle.

The pouring behavior of the melt into the casting mold can be further improved due to the fact that an inner surface of the at least one casting vessel and the external face of the at least one casting vessel extend parallel with one another.

Very good flow conditions and a very smooth melt front can be obtained during the process of pouring the melt from the casting vessel into the casting mold due to the fact that the at least one casting vessel has a pouring edge across which the melt is poured into the at least one casting mold, and the width of the pouring edge corresponds to a width of the.

The pouring operation can be further improved due to the fact that the pouring edge of the at least one casting vessel and a cast-in edge of the at least one feeder are disposed congruently with one another or form a step, the height of which is less than 10 mm.

To enable a very smooth flow of melt in the feeder, a surface of the feeder is of a flat design in a region adjoining its cast-in edge and subtends an angle of between 80 and 100°, preferably an angle of between 85° and 95°, with the end face of the feeder.

In order to guarantee a smooth inflow of the melt from the feeder into a mold cavity of the casting mold, the feeder may have, at what is a rear section of the surface as viewed in the pouring direction, a section which subtends an angle of more than 90°, preferably an angle of more than 100° and less than 160°, with the region of the surface of the feeder adjoining the cast-in edge. It has proved to be of particular practical advantage if the feeder is provided in the form of at least one sand mold.

Based on another advantageous embodiment, the device comprises at least one robot arm for at least moving the at least one casting vessel to the at least one casting mold and at least one sensor for detecting a level of the metal melt in the casting vessel as well as at least one controller connected to the at least one sensor which is configured to control the robot arm as a function of the signals generated by the at least one sensor.

The controller is advantageously configured to control the movement of the robot arm and an actuator for operating the casting mold so that the level of the metal melt is settled at the start of the process of pouring the metal melt from the casting vessel into the casting mold and lies at the same height as an inner surface of the casting mold.

The settled level of the metal melt in the casting vessel can be easily adjusted by tilting it before pouring because at a connection point to a casting mold, the casting vessel has a pouring opening and a movable cover is provided for the pouring opening to prevent undesired spillage of metal melt into the casting mold.

An embodiment that also lends itself very well to the use of an inert gas is one in which the cover is provided in the form of a lid that is connected to the casting vessel and can be lifted or pivoted open. To this end, the lid is designed to enable the casting vessel to be closed in a gas-tight arrangement.

The invention as well as other advantages will be explained in more detail below on the basis of an embodiment illustrated as an example in the appended drawings, although this should not be construed as restrictive. Of the very schematically simplified diagrams:

Figure 1:
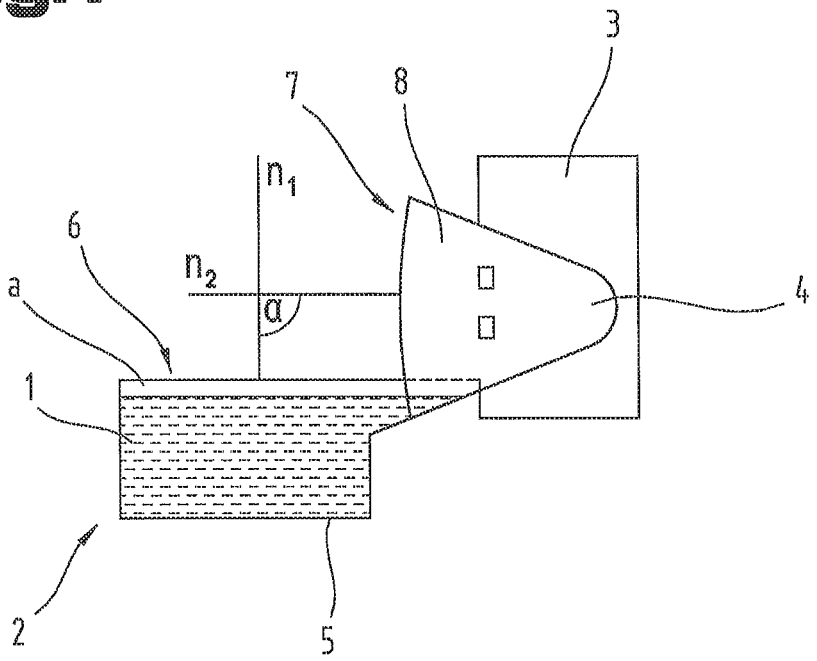
FIG. 1 illustrates the position of a casting vessel and a casting mold prior to the process of pouring the metal melt from the casting vessel into the casting mold.
Figure 2:
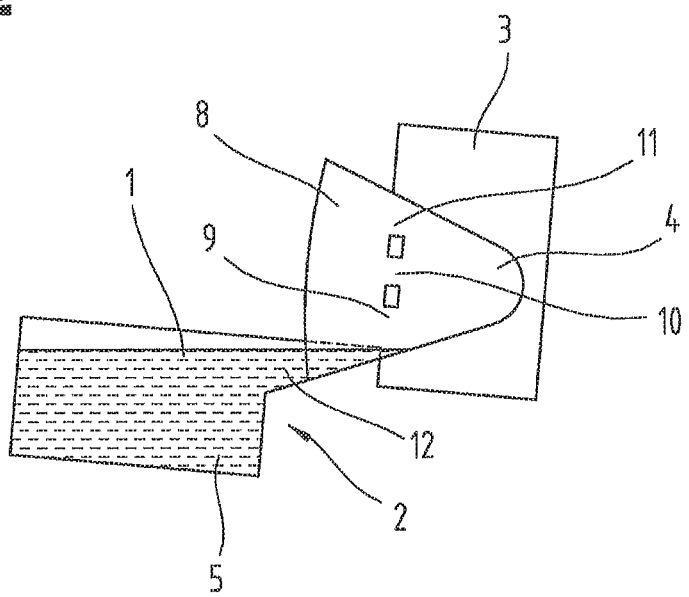
FIG. 2 illustrates the casting vessel and casting mold shown in FIG. 1 in a first position during the pouring process.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

As illustrated in FIGS. 1-4, the type of casting used by the method of casting a cast part as proposed by the invention is based on the tilt pour casting principle. The method proposed by the invention is known as balanced level casting. Accordingly, a metal melt 1 is poured from a tiltable casting vessel 2 into a casting mold 3 with a cavity 4 that forms the cast part. FIGS. 1-4 illustrate the casting vessel 2 and casting mold 3 in different consecutive positions over a period of time. The pouring operation may also be carried out using two or more casting vessels 2 disposed parallel with one another, for example casting ladles.

Figure 4:
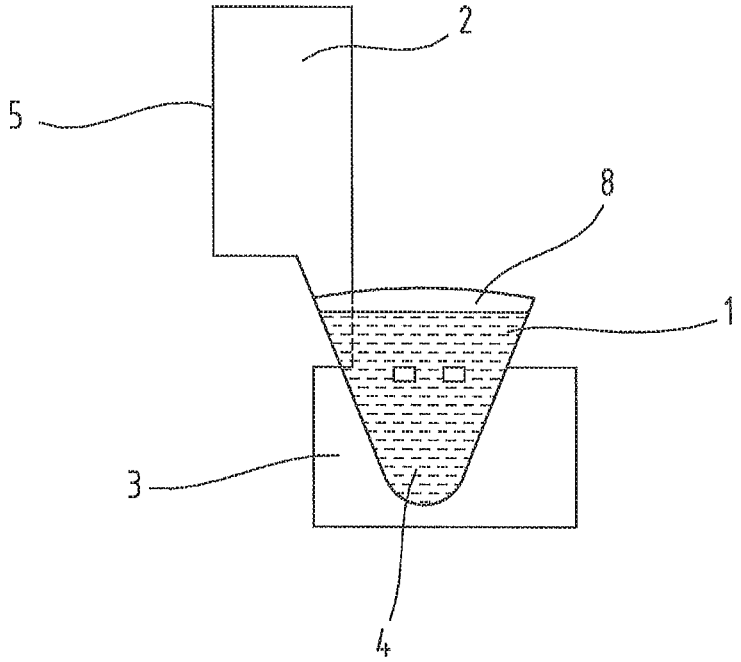
FIG. 4 illustrates the casting vessel and casting mold shown in FIG. 1 in a position in which the metal melt has been completely poured out of the casting vessel into the casting mold.

The timing of the sequence starts with FIG. 1 and ends with FIG. 4. The operation of pouring the metal melt 1 can be initiated by tilting the casting vessel 2 in the direction of the casting mold 3. After this, the casting vessel and casting mold can be tilted jointly and in the same direction during the process of pouring the metal melt.

As may be seen from FIG. 1, the casting vessel 2 and casting mold 3 are positioned adjacent to one another before pouring the metal melt 1. During a process of filling with metal melt 1, the casting vessel 2 may be spatially separated from the casting mold 3. After filling the casting vessel 2 with a quantity of metal melt needed to fill the casting mold 3, the casting vessel 2 can be moved to the casting mold 3, for example by a robot arm, and secured to the casting mold 3 by the robot arm. The robot arm is indicated by broken lines in FIG. 3 and is denoted by reference 13. The casting vessel 2 may also be mechanically connected the casting mold 3 and sealed, for example by suspending the casting vessel 2 in the casting mold 3. The casting mold 3 and casting vessel 2 can then be jointly tilted about an axis. Having connected the casting vessel 2 to the casting mold 3, the robot arm 13 can then release the casting vessel 2 and is then available for some other work operation.

In a second step, the metal melt 1 in the casting vessel 2 is settled. This is done by waiting until the position of the metal melt 1 in the casting vessel 2 has stabilized and has assumed a constant level. To this end, the casting vessel 2 and casting mold 3 are positioned so that a settled level a of the metal melt 1 before pouring the metal melt from the casting vessel 2 into the casting mold 3 lies at the same height in the casting vessel 2 as a section of an inner surface of the casting mold 3, as illustrated in FIG. 1. The purpose of settling the metal melt 1 in the casting vessel 2 is to ensure that pouring is as smooth as possible. The level of the melt can be detected by means of one or more sensors. In order to reduce oxide formation, the casting vessel 2 may also be filled with an inert gas. An embodiment such as that illustrated in FIG. 6 in which the casting vessel 2 can be closed by means of a cover 19 after filling it with metal melt 1 is particularly suitable for this purpose.

In its deepest region, the casting vessel 2 may have at least one flat base portion 5 extending in a straight line and before pouring, the casting vessel 2 is positioned so that the settled level a of the metal melt at the start of the pouring operation extends parallel with the base portion 5. At this stage, it should be pointed out that the casting vessel 2 may also have a differently shaped base, for example rounded.

As may also be seen from FIG. 1, the casting vessel 2 and casting mold 3 before pouring the metal melt 1 can be positioned so that a normal n1 to the base portion 5 and an opening 6 of the casting vessel 2 lying opposite the base portion and a normal n2 to a cast-in opening 7 of the casting mold 3 subtend an angle $\alpha$ of ca. 45°-100°. This angle $\alpha$ may remain constant during pouring so that the relative position of the casting vessel 2 and casting mold 3 remains unchanged during pouring. Alternatively, however, the angle $\alpha$ may be varied during pouring, in which case the relative mutual positions of the casting vessel 2 and casting mold 3 will change.

The method proposed by the invention enables the settled level a of the metal melt 1, which necessarily sits horizontally, to be kept parallel with a base of the casting vessel 2 and to be so at the instant when pouring is initiated, and this level a more preferably corresponds to the deepest level of the mold cavity 4 of the casting mold 3 at the start of the pouring operation. From the position illustrated at the start of the pouring operation, the casting mold 3 has been pivoted by ca. −90° as illustrated in FIG. 4 by the time pouring is terminated, as may be seen by comparing FIGS. 1 and 4. Based on the balanced level casting method proposed by the invention, the movements of the casting vessel and/or casting mold may be controlled during the pouring operation so that the surface of the melt is more or less smooth during the entire pouring process.

Furthermore, the casting vessel 2 filled with the metal melt 1 can be moved to the casting mold with a pendulum motion, for example, and the pendulum motion may be effected in the direction opposite oscillations of the metal melt 1.

Figure 6:
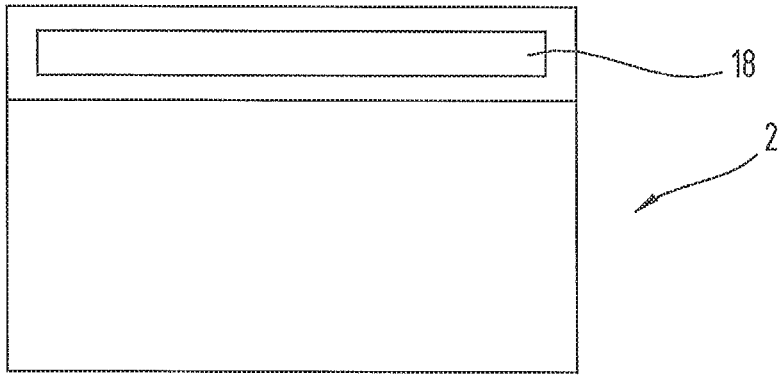
FIG. 6 illustrates a front view of the casting vessel from FIGS. 1 to 4.

The casting vessel 2 may have a gate opening directly into the mold cavity 4, and the mold cavity 4 is directly connected via a gate to the casting vessel 2 during the process of pouring the metal melt 1. In this latter case, the gate of the casting vessel 2 may be formed by a section 12 of the casting vessel 2 having a pouring opening 18 as illustrated in FIG. 6.

As an alternative to an embodiment with a gate on the casting vessel 2, the casting mold 3 may be provided with a gate 8. This gate 8 may have several passages 9, 10, 11 which may be used to fill the mold cavity 4 and to vent it during filling. On a side facing the casting mold 3, the casting vessel 2 may also have a section 12 co-operating with the gate 8 to guarantee a good connection between the casting vessel 2 and casting mold 3. The section 12 and a section of the gate 8 co-operating with it are preferably disposed congruently with one another and the section 12 may locate in the gate 8 and be surrounded by it to enable a mechanical connection to be established between the casting vessel 2 and casting mold 3.

The gate 8 may extend across essentially an entire width of the mold cavity 4 facing the casting vessel 2. Some of the metal melt may also remain in the gate 8 as a feeder volume.

Figure 3:
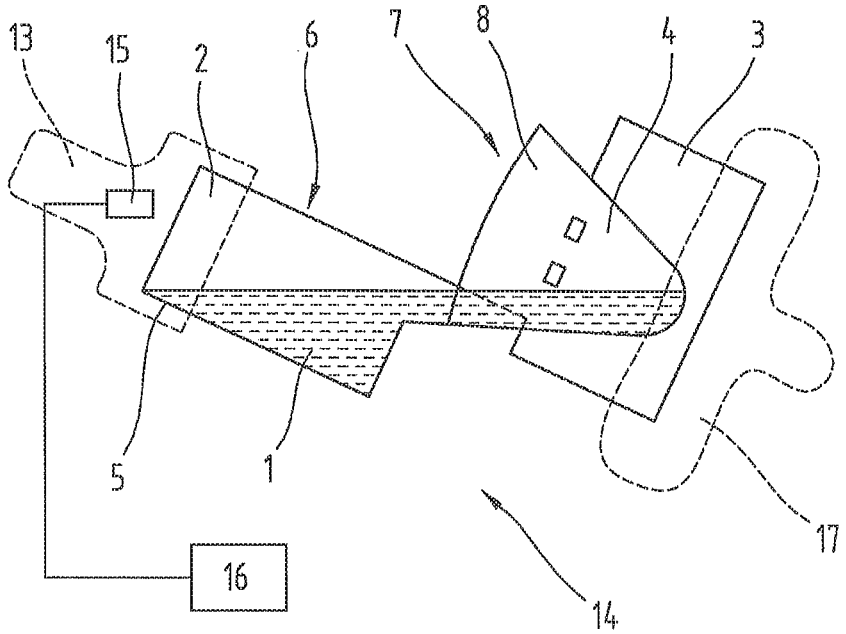
FIG. 3 illustrates the casting vessel and casting mold shown in FIG. 1 in a second position during the process of pouring the metal melt.
Figure 5:
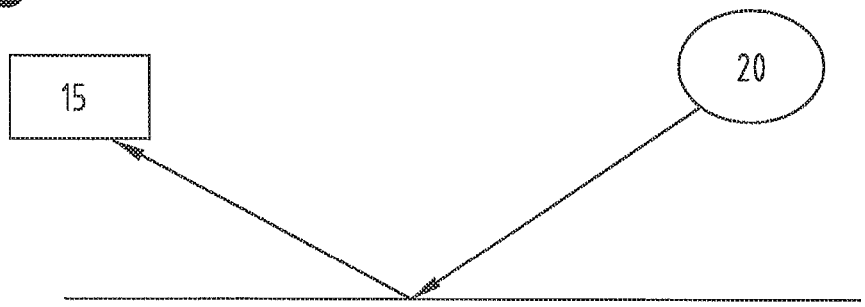
FIG. 5 illustrates a sensor for detecting a level of the metal melt.

The device 14 for implementing the method proposed by the invention illustrated in FIG. 3 may comprise one or more sensors 15 for detecting the level of the metal melt 1 in the casting vessel 2 as well as a controller 16 connected to the sensor 15, for example a signal processor or microprocessor programmed accordingly, configured to control the robot arm 13 as a function of signals generated by the sensor 15. As illustrated in FIG. 5, the sensor 15 may be a light-sensitive sensor, for example, which receives light from a light source 20 reflected on the surface of the metal melt and converts it into electric signals. The intensity of the light measured by the sensor 15 varies with oscillations of the level of the metal melt compared with a settled surface, making it possible to detect whether the level of the metal melt 1 has settled with the set-up described above.

To this end, the controller 16 may be configured to control the movement of the robot arm 13 and an actuator 17 for operating the casting mold 3 in such a way that the level of the metal melt 1 is settled at the start of pouring the metal melt 1 from the casting vessel 2 into the casting mold 3 and lies at the same height as an inner surface of the casting mold 3. The casting mold 3 can be tilted with the aid of the actuator, for example of another robot arm or a motor.

As illustrated in FIG. 6, the casting vessel 2 may have a pouring opening 18 at a connection point to a casting mold 3. The pouring opening 18 may extend across the entire width of the mold cavity 4.

Figure 7:
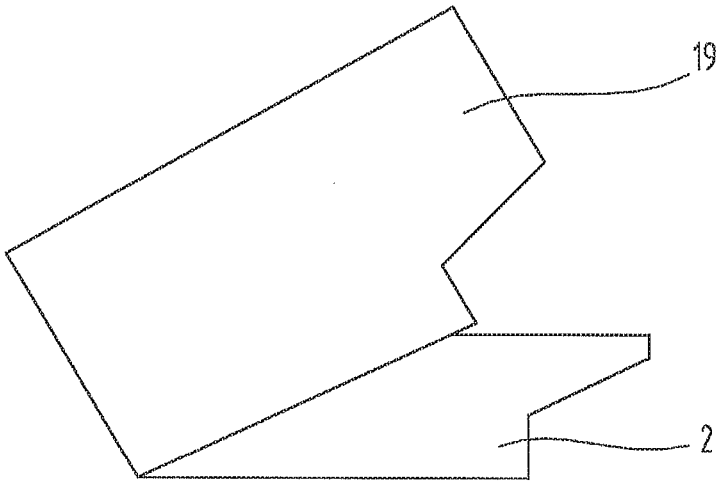
FIG. 7 illustrates a variant of a casting vessel.

A movable cover may also be provided for the pouring opening 18. The cover may be a closing cap for the pouring opening 18 or a plate which can be displaced in the plane of the pouring opening 18. However, the cover 19 may also be a pivotable lid as illustrated in FIG. 7. The advantage of using a cover is that the casting vessel 2 can be correctly positioned and oriented relative to the casting mold 3 and spillage of the melt prevented with the pouring opening 18 closed before pouring. Once the cover has been removed, the process of pouring the metal melt 1 from the casting vessel 2 into the casting mold 3 can proceed.

The embodiment illustrated in FIG. 7 is suitable if using an inert gas because the casting vessel 2 can be closed by the lid once filled with melt and the casting vessel 2 can be filled with inert gas via an intake orifice provided with a valve, for example, although this is not illustrated.

Figure 8:
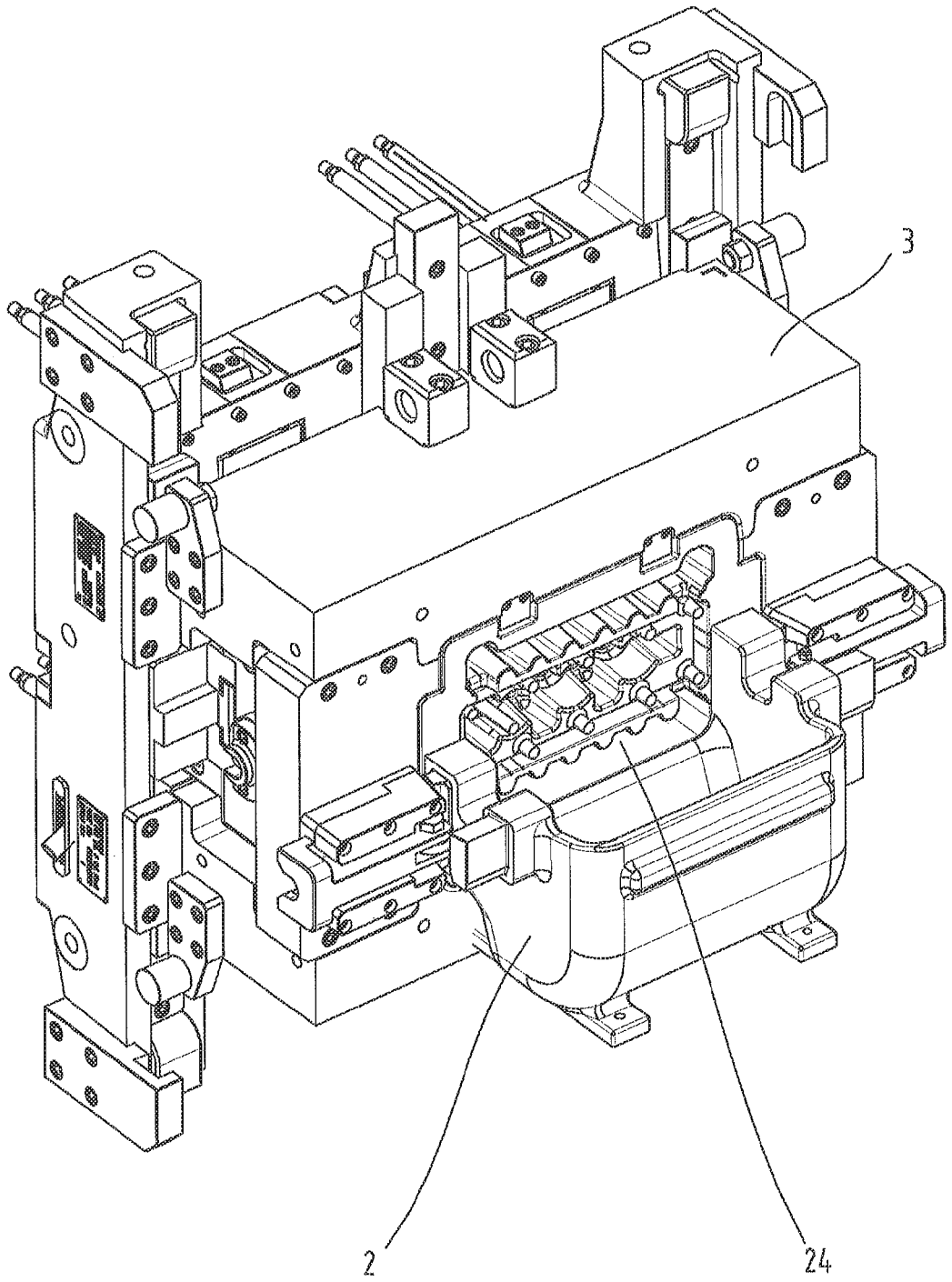
FIG. 8 is a perspective view illustrating a part of a device proposed by the invention and FIG. 9 illustrates a section through the device illustrated in FIG. 8.
Figure 9:
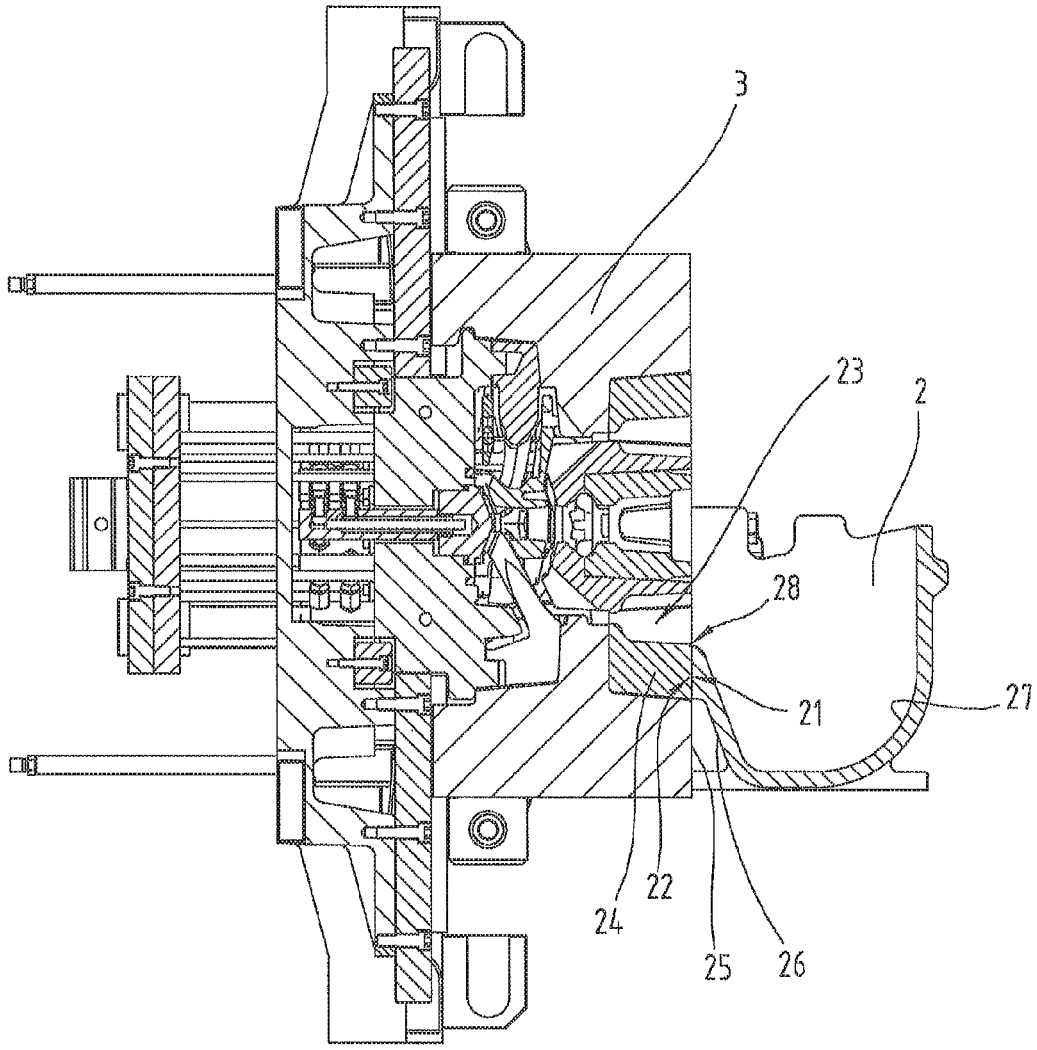

Based on the embodiment illustrated as an example in FIGS. 8 and 9, the casting vessel 2 and casting mold 3 can be connected to one another, and the casting vessel can be suspended in the casting mold 3 and locked there. The connection between the casting vessel 2 and casting mold 3 may be based on a positive and/or non-positive connection.

As illustrated in FIG. 9, once the casting vessel 2 and casting mold 3 have been connected, an end face 21 of the casting vessel 2 facing the casting mold 3 extends parallel with an end face 22 of a feeder 23 and lies against it. The feeder 23 may be provided in the form of a sand mold 24. The end faces 21, 22 of the casting vessel 2 and feeder 23 as well as the sand mold 24 may be complementary in terms of their surfaces and their contours. The end faces 21, 22 may also be disposed congruently with one another. For example, one of the end faces 21, 22 may have one or more projections whilst the other one of the end faces 21, 22 has complementary recesses. The sand mold 24 is also often referred to as a "cover core". In the embodiment illustrated, the feeder 23 is part of the pouring system and is a so-called open feeder.

An external face 26 of the casting vessel 2 facing an external face 25 of the casting mold 3 and the external face 25 may subtend an acute angle, in other words an angle of less than 90°. An inner surface 27 of the casting vessel 2 and the external face 26 may extend parallel with one another.

The casting vessel 2 may have a pouring edge 28 across which the melt passes into the casting mold 3. The width of the pouring edge 28 may correspond to a width of the feeder 23 and/or a width of the sand mold 24 inserted in the feeder 23. The pouring edge 28 and a cast-in edge of the sand mold 24 may be steplessly aligned with one another or may form a step, the height of which is less than 10 mm. The cast-in edge of the sand mold 24 is not provided with a separate reference number in FIG. 9 in order to retain clarity in the drawing. However, the cast-in edge is positioned directly adjoining the pouring edge denoted by reference number 28.

A surface of the sand mold 24 may be of a flat design in the region adjoining its cast-in edge and subtends an angle of between 80 and 100°, preferably an angle of between 85° and 95°, with the end face 22. Based on the diagram in FIG. 9, the angle between the surface of the sand mold and the end face is approximately 90°, for example.

In a rear section, as viewed in the pouring direction, which merges into a mold cavity, the surface of the sand mold 24 may have a section subtending an angle of more than 90°, preferably an angle of more than 100° and less than 160°, with the region of the surface of the sand mold 24 adjoining the cast-in edge. The embodiments illustrated in FIGS. 8 and 9 are also very well suited to implementing the method proposed by the invention, and the embodiments illustrated in FIGS. 8 and 9 may additionally also incorporate all the device features of the embodiments illustrated in FIGS. 1 to 7.

The embodiments illustrated as examples represent possible variants of the solution proposed by the invention and it should be pointed out at this stage that the invention is not specifically limited to the variants specifically illustrated. All variants of embodiments falling within the meaning of the independent claims are covered by the scope of the invention.

LIST OF REFERENCE NUMBERS

1 Metal melt
2 Casting vessel
3 Casting mold
4 Mold cavity
5 Base portion
6 Opening
7 Cast-in opening
8 Gate
9 Passage
10 Passage
11 Passage
12 Section
13 Robot arm
14 Device
15 Sensor
16 Controller
17 Actuator
18 Pouring opening
19 Cover
20 Light source
21 End face
22 End face
23 Feeder
24 Sand mold
25 External face
26 External face
27 Inner surface
28 Pouring edge

The invention claimed is:

1. Method for casting a cast part based on the tilt pour casting principle, whereby metal melt (1) is poured from at least one tiltable casting vessel (2) into a casting mold (3) having a mold cavity (4) that forms the cast part, the at least one casting vessel (2) and the casting mold (3) are arranged next to each other in one step, wherein in a subsequent step the metal melt (1) is settled, and the at least one casting vessel (2) and the casting mold are positioned in such a way that, before pouring the metal melt (1) from the at least one casting vessel (2) into the casting mold (3), a settled level (a) of the metal melt (1) in the at least one casting vessel (2) is at the same height as one section of an inner surface of the casting mold (3), and the at least one casting vessel (2) and the casting mold (3) are positioned in such a way that, before pouring, the settled level (a) of the metal melt in the at least one casting vessel is at least at the same height as the deepest lying section of the mold cavity (4), wherein the at least one casting vessel (2) filled with metal melt (1) is moved to the casting mold with a pendulum motion and the pendulum motion is effected in the direction opposite oscillations of the metal melt (1).

2. Method according to claim 1, wherein the at least one casting vessel (2) is positioned in such a way that, before pouring, the settled level (a) of the metal melt (1) at the start of the pouring operation extends parallel with a wall section.

3. Method according to claim 1, wherein the at least one casting vessel (2) has a gate opening directly into the mold cavity (4) and the mold cavity (4) is connected directly via the gate to the at least one casting vessel (2) during the process of pouring the metal melt (1).

4. Method according to claim 3, wherein the gate (8) extends essentially across an entire width of the mold cavity (4) facing the at least one casting vessel (2) and a part of the melt remains in the gate as a feeder volume.

5. Method according to claim 1, wherein the process of pouring the metal melt (1) is initiated by tilting the at least one casting vessel (2) in the direction of the casting mold (3) or the at least one casting vessel and casting mold are jointly rotated in the same direction about a common axis in order to initiate the pouring operation.

6. Method according to claim 5, wherein the at least one casting vessel (2) and casting mold (3) are tilted jointly and in the same direction during the process of pouring the metal melt (1).

7. Method according to claim 1, wherein the at least one casting vessel (2) is spatially separated from the casting mold (3) during the process of filling it with metal melt and after filling is moved to the casting mold (3) and secured on the casting mold (3) by a robot arm (13).

8. Method according to claim 1, wherein the level of the metal melt is detected by means of at least one sensor.

9. Device (14) for tilt pour casting having at least one casting vessel (2) and at least one casting mold (3)), which the at least one casting vessel (2) and the at least one casting mold (3) can be connected to one another, and in a connected state of the at least one casting vessel (2) and the at least one casting mold (3) an end face (21) of the at least one casting vessel (2) facing the at least one casting mold (3) extends parallel with and lies against an end face (22) of at least one feeder (23) of the at least one casting mold (3), wherein the at least one casting vessel (2) has a pouring edge (28) across which the melt is poured into the at least one casting mold (3), and the width of the pouring edge (28) corresponds to the width of the at least one feeder (23), wherein the device comprises at least one robot arm (13) for at least moving the at least one casting vessel (2) to the at least one casting mold (3) as well as at least one sensor (15) for detecting a level of the metal melt (1) in the at least one casting vessel (2) and at least one controller (16) connected to the at least one sensor (15), which is configured to control the at least one robot arm (13) as a function of signals generated by the at least one sensor (15), wherein the at least one controller is configured to control the at least one robot arm such that the at least one casting vessel (2) filled with metal melt (1) is moved to the at least one casting mold with a pendulum motion and the pendulum motion is effected in the direction opposite oscillations of the metal melt (1).

10. Device according to claim 9, wherein the end faces (21, 22) of the at least one casting vessel (2) and the at least one feeder complement one another in terms of their surfaces and their contours.

11. Device as claimed in claim 9, wherein an external face (26) of the at least one casting vessel (2) facing an external face (25) of the at least one casting mold (3) and the external face (25) of the at least one casting mold (3) subtend an acute angle.

12. Device according to claim 11, wherein an inner surface (27) of the at least one casting vessel (2) and the external face (26) of the at least one casting vessel (2) extend parallel with one another.

13. Device according to claim 9, wherein the pouring edge (28) of the at least one casting vessel (2) and a cast-in edge of the at least one feeder (23) are steplessly aligned with one another or form a step, the height of which is less than 10% of a height of the at least one feeder (23) extending transversely to the cast-in edge and parallel with the end face.

14. Device according to claim 13, wherein a surface of the at least one feeder (23) in a region adjoining its cast-in edge is of a flat design and subtends an angle of between 80 and 100°, with the end face (22) of the at least one feeder.

15. Device according to claim 14, wherein the at least one feeder (23) has, at what is a rear section of the surface as viewed in the pouring direction, a section which subtends an angle of more than 90°, with the region of the surface of the at least one feeder (23) adjoining the cast-in edge.

16. Device according to claim 9, wherein the at least one feeder (23) is provided in the form of at least one sand mold (24).

17. Device according to claim 9, wherein the at least one controller (16) is configured to control the movement of the at least one robot arm (13) and an actuator (17) for operating the at least one casting mold (3) in such a way that the level of the metal melt (1) is settled at the start of pouring the metal melt (1) from the at least one casting vessel (2) into the at least one casting mold (3) and lies at the same height as an inner surface of the at least one casting mold (3).

18. Device according to claim 9, wherein the at least one casting vessel (2) has a pouring opening (18) at a connection point to the at least one casting mold (3) and a movable cover (19) is provided for the pouring opening.

19. Device according to claim 18, wherein the cover is provided in the form of a lid which is mounted on the at least one casting vessel (2) so that it can be pivoted or lifted.

* * * * *